US005305816A

United States Patent [19]

Ikawa

[11] Patent Number: 5,305,816

[45] Date of Patent: Apr. 26, 1994

[54] METHOD OF PRODUCING LONG SIZE PREFORM USING SPRAY DEPOSIT

[75] Inventor: Yoshio Ikawa, Niihama, Japan

[73] Assignee: Sumitomo Heavy Industries, Ltd., Tokyo, Japan

[21] Appl. No.: 115,800

[22] Filed: Sep. 3, 1993

Related U.S. Application Data

[63] Continuation of Ser. No. 888,663, May 27, 1992, abandoned.

[30] Foreign Application Priority Data

Jun. 21, 1991 [JP] Japan ..... 3-177150
Jul. 5, 1991 [JP] Japan ..... 3-192552

[51] Int. Cl.[5] ..... B22D 11/00; B22D 19/00

[52] U.S. Cl. ..... 164/46; 164/98; 164/461

[58] Field of Search ..... 164/46, 461, 98

[56] References Cited

U.S. PATENT DOCUMENTS 3,670,400 6/1972 Singer ..... 164/46

FOREIGN PATENT DOCUMENTS 2043882 3/1971 Fed. Rep. of Germany ..... 164/46
54-29985 9/1979 Japan .
56-12220 3/1981 Japan .
64-15264 1/1989 Japan .
2-263543 10/1990 Japan ..... 164/46
1379261 1/1975 United Kingdom .
1599392 9/1981 United Kingdom .
2172825 10/1986 United Kingdom ..... 164/46

OTHER PUBLICATIONS

H. C. Fiedler et al., "The Spray Forming of Superalloys," *Journal of Metals*, Aug., 1987, pp. 28–33.

*Primary Examiner*—Paula A. Bradley
*Assistant Examiner*—Jeffrey T. Knapp
*Attorney, Agent, or Firm*—Nikaido, Marmelstein, Murray & Oram

[57] ABSTRACT

A method of producing long size preform is disclosed in which: a long size cylindrical collector extended in a manner penetrating a chamber is moved lengthwise thereof while it is rotated; a preheated metal layer is formed on the outer periphery of the collector by adhering a molten metal to the collector within the chamber at the upstream side in the traveling direction of the collector; and a molten metal is caused to be cumulated by spray deposit on the metal layer formed on the outer periphery of the collector by spraying the molten metal from the ceiling within the chamber at the downstream side in the traveling direction of the collector by way of an atomizer which ejects an inert gas. By using this method, porosity occurring on the collector side of the preform may be inhibited.

7 Claims, 7 Drawing Sheets

METHOD OF PRODUCING LONG SIZE PREFORM USING SPRAY DEPOSIT

This application is a continuation of application Ser. No. 07/888,663 filed May 27, 1992, now abandoned.

BACKGROUND OF THE INVENTION

1. Field of the Invention

The present invention relates to manufacturing methods of a long size round preform (including clad material) and sheet preform (including clad material) by means of spray deposit.

2. Description of the Related Art

As a forming method of preform (preliminarily shaped material), spray deposit method is conventionally known in which a molten metal is atomized using an inert gas so that the finely broken droplets are rapidly cooled and solidified while they are sprayed to be deposited on a collector. (See, for example, Japanese patent Examined Publication Nos. 54-29985, 56-12220 and Japanese Patent Unexamined Publication No. 64-15264). In comparison to an ordinary casting, the spray deposit method is characterized for example by: formation of uniform microstructure due to rapid cooling and solidification; free from macrosegregation; and excellent workability and forgeability.

Further, production methods with simplified rolling process are generally known in production of sheet preform (strip), i.e., such as single roll system, roll belt system, twin roll system, and twin belt system are known as special types of continuous casting facility where melting → continuous casting → rolling are consistently performed.

When a long size round preform is formed by a conventional spray deposit method, less porosity is achieved and a preform with higher density is obtained and at the same time productivity is higher comparing to thermal spraying in which a laminated coat is formed by spraying particle groups of a molten metal to the surface of a clad material.

If such rapid cooling and solidification are excessively performed, however, porosity appears and a high density preform is hardly obtained. Presumably, the cause of such porosity is that, if cooling by gas is excessively performed, the ratio of solid phase particles to the particles to be cumulated on the preform is increased and the number of liquid phase and semi-liquid particles that are to fill the gap between the solid phase particles is reduced whereby the gap between the solid phase particles remains as it is to cause porosity. Further it is presumed that, when the temperature of a particle is relatively low, the particle is less likely to be flattened at the time of its collision and a part is formed which is hidden from the particles that will come next. Such hidden part is filled if those particles coming next are at a sufficiently high temperature to have proper liquid area. But porosity appears if particles temperature is too low or if the density of the particles is relatively low, because the particles coming next are unable to completely fill the gap between former particles.

Although, as described, the cause of occurrence of porosity in a preform is presumably related to temperature, its cause is not yet clear-cut. For example, when a round preform is manufactured, porous layer often appears in the interface of a tube-forming collector. From this analysis, it is assumed that the particles contacting the collector are lowered in temperature and porosity is caused due to the reason as described above.

Thus, preheating of the collector is to be considered. Application of such as high-frequency heating or plasma heating as the method of preheating, however, causes discontinuity of preheating (i.e. temperature difference in the longitudinal direction) in the case of a tube-like long size article and the occurrence of local porosity still remains as a problem.

On the other hand, use of the above-described single-roll type continuous casting (single roll type strip caster) as the method for obtaining a sheet preform is simple in structure and at the same time is capable of providing a relatively large cooling area. It thus has an advantage of higher productivity for example comparing to a twin roll type strip caster. It is difficult, however, to control the thickness, and, since the cooling rate at the roll side and the cooling rate at surface side of the strip are different, defects are easily caused at the superficial portion of the strip.

Moreover, there is also a problem that its productivity is significantly lower comparing to an ordinary continuous casting facility which produces cast pieces such as of slab or billet.

Further, spray deposit method is also known as a manufacturing method of sheet preform. With the spray deposit method, however, porosity appears and a preform having high density cannot be obtained when rapid cooling and solidification are excessively performed, as is the case as described in forming a long size round preform.

Thus, the present inventor has already proposed a manufacturing method of composite metal material using spray deposit method, as described in the above-mentioned Japanese Patent Unexamined Publication No. 64-15264. The manufacturing method is thereby disclosed in which a separately prepared molten metal to be used for preheating is caused to flow down on a plate base metal to form a coating layer on the base metal prior to spray deposit for a different metal and spray flow is then cumulated on this coating layer for the different metal. In such manufacturing method, a coating layer of preheating molten metal is interposed to increase the joining force between the different metal and the base material. Thus, while formation of a preform integrally incorporated into the base material is possible, there is a problem that it is impossible to continuously obtain a formed product having a plate preform layer.

SUMMARY OF THE INVENTION

It is an object of the present invention to provide a method of producing a long size preform using spray deposit method, capable of at once eliminating the above described problems.

To achieve the above described object, a method of producing a long size preform using spray deposit is provided in accordance with the present invention, which includes the steps of: causing a cylindrical collector for a long size preform to move longitudinally within a chamber while it is rotated about the axis thereof; forming preheated metal layer on the outer periphery of the collector by adhering molten metal to the collector at the upstream side in the traveling direction of the collector within the chamber; and providing a container containing molten metal for performing spray deposit by means of atomizer ejecting inert gas on the ceiling of the chamber at the downstream side in the traveling direction of the collector to cumulate the molten metal sprayed from the container on said metal layer of the collector; whereby porosity of the preform on the collector side is inhibited.

In accordance with an embodiment of the present invention, the above described step for forming a preheated metal layer on the outer periphery of the collector is implemented by providing a second container containing a preheating molten metal on the ceiling of said chamber a the upstream side in the traveling direction of the collector to cause the preheating metal to flow down over the collector from the second container.

In accordance with another embodiment of the present invention, the above described step for forming a preheated metal layer on the outer periphery of the collector is implemented such that a preheater is provided at the upstream side in the traveling direction of the collector and a second container containing a molten metal for forming a metal layer is provided on the ceiling of said chamber at the upstream side whereby the molten metal is sprayed at a low pressure from the second container to the preheated collector.

In accordance with still another embodiment of the present invention, the above described step for forming a preheated metal layer on the outer periphery of the collector is implemented such that a preheater and a second container containing a preheating molten metal and having a wide pouring outlet extending lengthwise of the collector in proximity to the outer peripheral surface of the collector are provided at the upstream side in the traveling direction of the collector whereby the molten metal is poured from the pouring outlet of the second container to the preheated collector.

In accordance with another aspect of the present invention, a method of producing sheet preform using spray deposit is provided, including the steps of: providing, adjacent to the upstream side of an inert atmosphere chamber having a single roll type collector therein, a casting container containing a molten metal and having a pouring outlet in proximity to the side surface of the collector and forming a metal layer for a certain angular range over the outer peripheral of the collector by rotating the collector while continuously pouring the molten metal over the outer periphery of the collector from the pouring outlet of the casting container; providing, on the ceiling of the chamber, a container containing a molten metal for performing spray deposit by way of an atomizer ejecting an inert gas and thereby forming a preform by cumulating the molten metal sprayed from the container on the metal layer on the outer periphery of the collector; and pulling out the preform formed on the collector toward the downstream side of the chamber while it is continuously stripped off from the collector toward a side thereof.

DESCRIPTION OF THE PREFERRED EMBODIMENTS

The present invention will now be described with respect to embodiments thereof as shown in the accompanying drawings.

Figure 1:
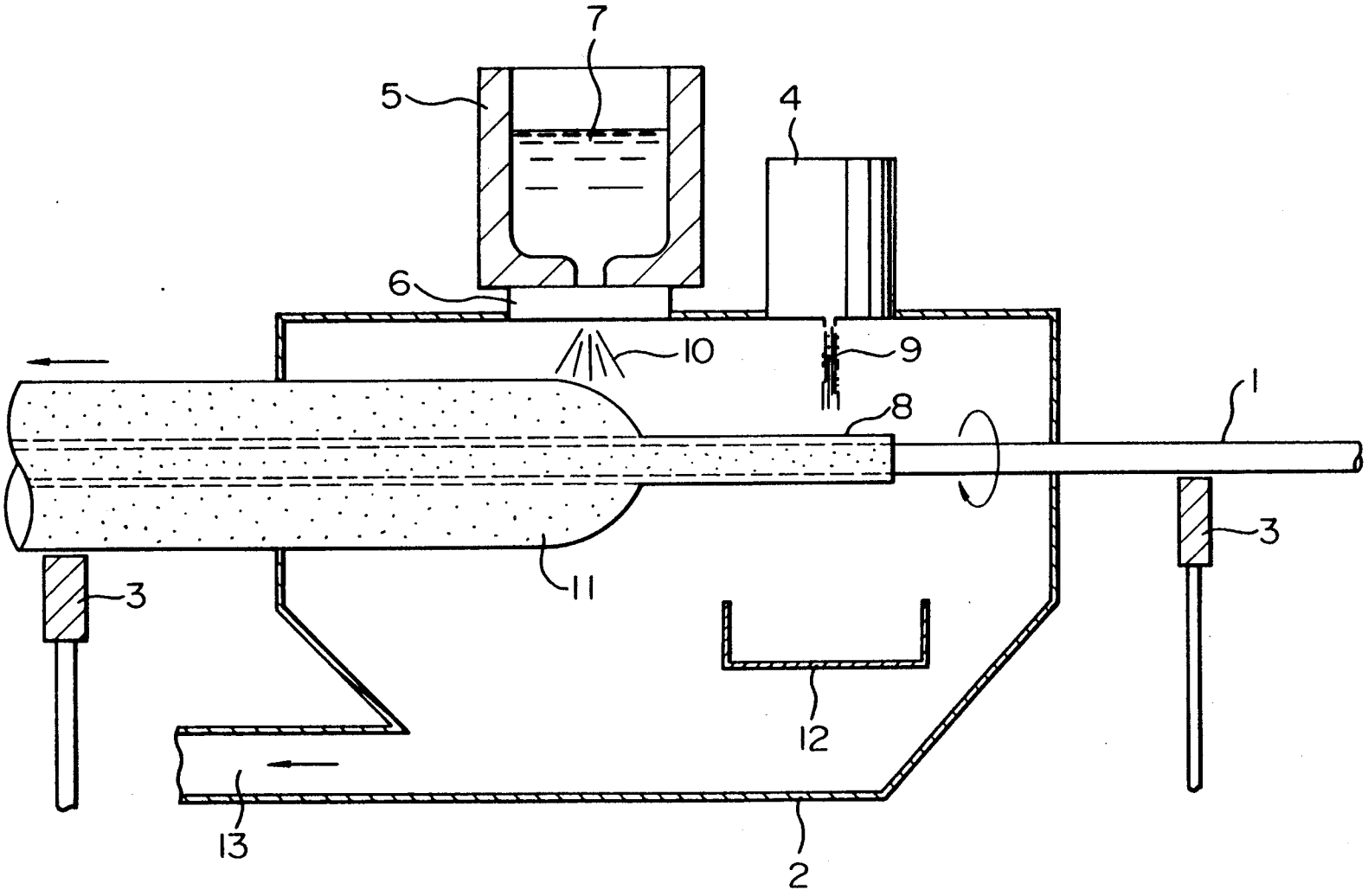
FIG. 1 schematically illustrates a first embodiment of the present invention.

FIG. 1 schematically illustrates a first embodiment of the present invention.

This embodiment is suitable for forming a long size round preform of iron or non-ferrous metal by means of a spray deposit apparatus (for example, "osprey" apparatus).

Referring to FIG. 1, a collector for a long size tube is denoted by numeral 1 which transversely penetrates a chamber 2 and is supported by collector support bases 3, 3 provided outside the chamber 2. It is rotated at 5–500 rpm and is capable of being slowly moved from right to left as shown in the figure.

On the ceiling side of the chamber 2, a container 4 constituted by a tundish or crucible or the like for preheating is provided by way of a nozzle (not shown) at the upstream side of the traveling direction of the collector 1. Further, at the downstream side thereof, a container 5 of a tundish or crucible or the like for spray deposit is provided by way of an atomizer 6. While these containers 4, 5 contain molten metals 7 of the same quality.

A metal flow 9 is caused to flow down from the preheating container 4 to form a metal film 8 on the collector 1. The temperature of this metal film 8 is measured by a thermometer such as a pyrometer (not shown) so as to control the amount of the metal flow 9. The spray flow 10 from the container 5 for spray deposit is controlled in a similar manner to that in an ordinary spray deposit apparatus to form a tube-like preform 11.

It should be noted that a dish 12 formed of refractory is provided directly beneath the preheating container 4 to receive a portion of the metal flow 9 which the collector 1 has been unable to capture. Further, a part of the spray flow 10 not captured by the collector 1 is collected by a dust collector (not shown) for example by way of an exhaust ventilator 13 similar to that in an ordinary spray deposit apparatus.

The operation of the present embodiment will now be described.

Firstly, the metal flow 9 is caused to flow down on the rotating collector 1 to form the metal film 8 around the periphery thereof and to preheat the collector 1 uniformly along the axial direction thereof. The portion of the collector 1 having the metal film 8 formed thereon is moved to a position directly beneath the container 5 for spray deposit to cumulate the spray flow 10 thereon. In forming an ordinary preform 11, its temperature at the collector 1 side is relatively lower and a porous layer appears between the collector 1 and the cumulated layer because it is formed by cumulating the spray flow 10 directly on a cold collector 1. However, according to the present embodiment, since the previously coated metal film 8 serves as a high temperature collector 1, the occurrence of porosity may be prevented. Further, since the deposited layer which will possibly be porous is caused to cumulate on the metal film at a high temperature by means of the metal film 8, the occurrence of porosity is prevented.

Figure 2:
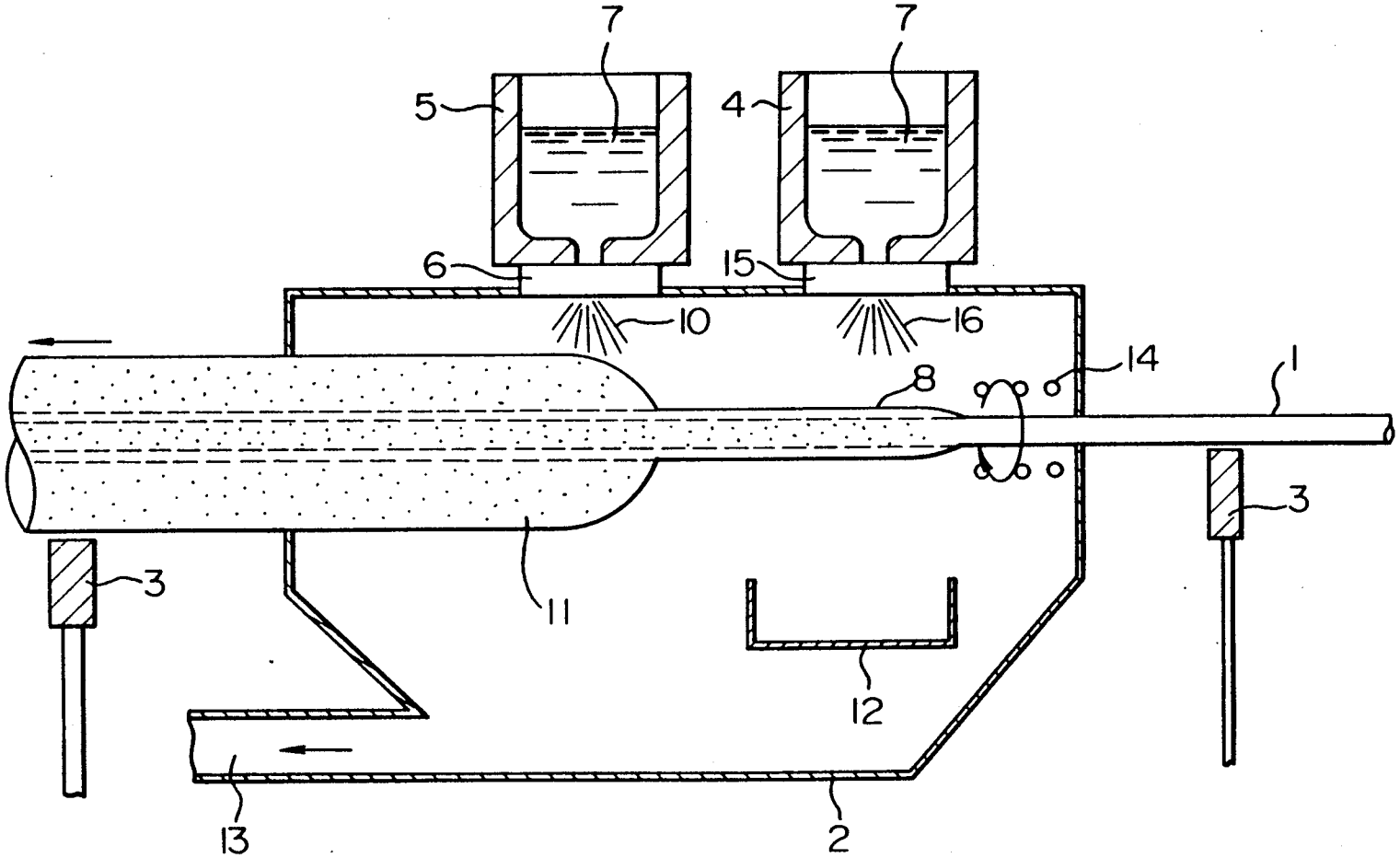
FIG. 2 schematically illustrates a second embodiment of the present invention.

FIG. 2 schematically illustrates a second embodiment of the present invention.

As in the first embodiment, this embodiment is also suitable for forming a long size round preform of iron or non-ferrous metal.

It should be noted that, since the second embodiment is fundamentally similar to the first embodiment, it will be described by giving identical reference numerals to those identical components.

Referring to FIG. 2, a collector for a long size tube is denoted by numeral 1 which transversely penetrates a chamber 2 and is supported by collector support bases 3, 3 provided outside the chamber 2. It is rotated at 5–500 rpm and is capable of being slowly moved from right to left as shown in the figure.

On the ceiling side of the chamber 2, a container 4 constituted such as by a tundish or crusible for low pressure spray is provided at the upstream side of the traveling direction of the collector 1 by way of a low pressure atomizer 15, i.e., an atomizer capable of providing the minimum pressure (less than several times the atmospheric pressure) that is necessary to break a metal flow. Further, at the downstream side thereof, a container 5 of a tundish or crucible or the like for spray deposit is provided by way of an atomizer 6. While these containers 4, 5 contain molten metals 7 of the same quality, the temperature of the molten metal in the low pressure spray container 4 is maintained at a slightly higher temperature.

Further, at the inlet area within the chamber 2 of the collector 1, a preheater 14 such as an induction heater is provided. A metal flow 16 is sprayed at a low pressure while it is oscillated to provide a uniform thickness from the container 4 for low pressure spray to the collector 1 which has been preheated by the preheater 14 to form a metal film 8 on the collector 1. The temperature of this metal film 8 is measured by a thermometer such as a pyrometer (not shown) so as to control the amount of the low pressure spray flow 16. A spray flow 10 from the container 5 to be used for spray deposit is controlled in a similar manner to that in an ordinary spray deposit apparatus to form a round preform 11.

It should be noted that a dish 12 formed of refractory is provided directly beneath the container 4 for low pressure spray to receive a part of the low pressure spray flow 16 which the collector 1 could not capture. Further, a part of the spray flow 10 not captured by the collector 1 is collected by a dust collector (not shown) for example by way of an exhaust ventilator 13 as in an ordinary spray deposit apparatus.

The operation of the present embodiment will now be described.

Firstly, the low pressure spray flow 16 is sprayed onto the rotating collector 1 which has been preheated so as to form a metal film 8 on the periphery thereof and to preheat the collector 1 uniformly along the axial direction thereof. The portion of the collector 1 having the metal film 8 formed thereon is then moved to a position directly beneath the container 5 for spray deposit and the spray flow 10 is cumulated thereon. In forming an ordinary preform 11, its temperature on the side of the collector 1 becomes relatively lower and a porous layer appears between the collector 1 and the cumulated layer, because it is formed by cumulating the spray flow 10 directly on a collector 1. According to the present embodiment, however, since the spray flow 10 is to be cumulated on the metal film 8 coated on the collector 1 which has been preheated in advance, the occurrence of porosity is prevented. Further, since the deposited layer which will possibly become a porous layer is cumulated on the metal film 8 (collector) by the interposition of the high temperature metal film 8, the occurrence of porosity may be prevented.

A third embodiment of the present invention will now be described with reference to FIGS. 3 and 4.

Figure 3:
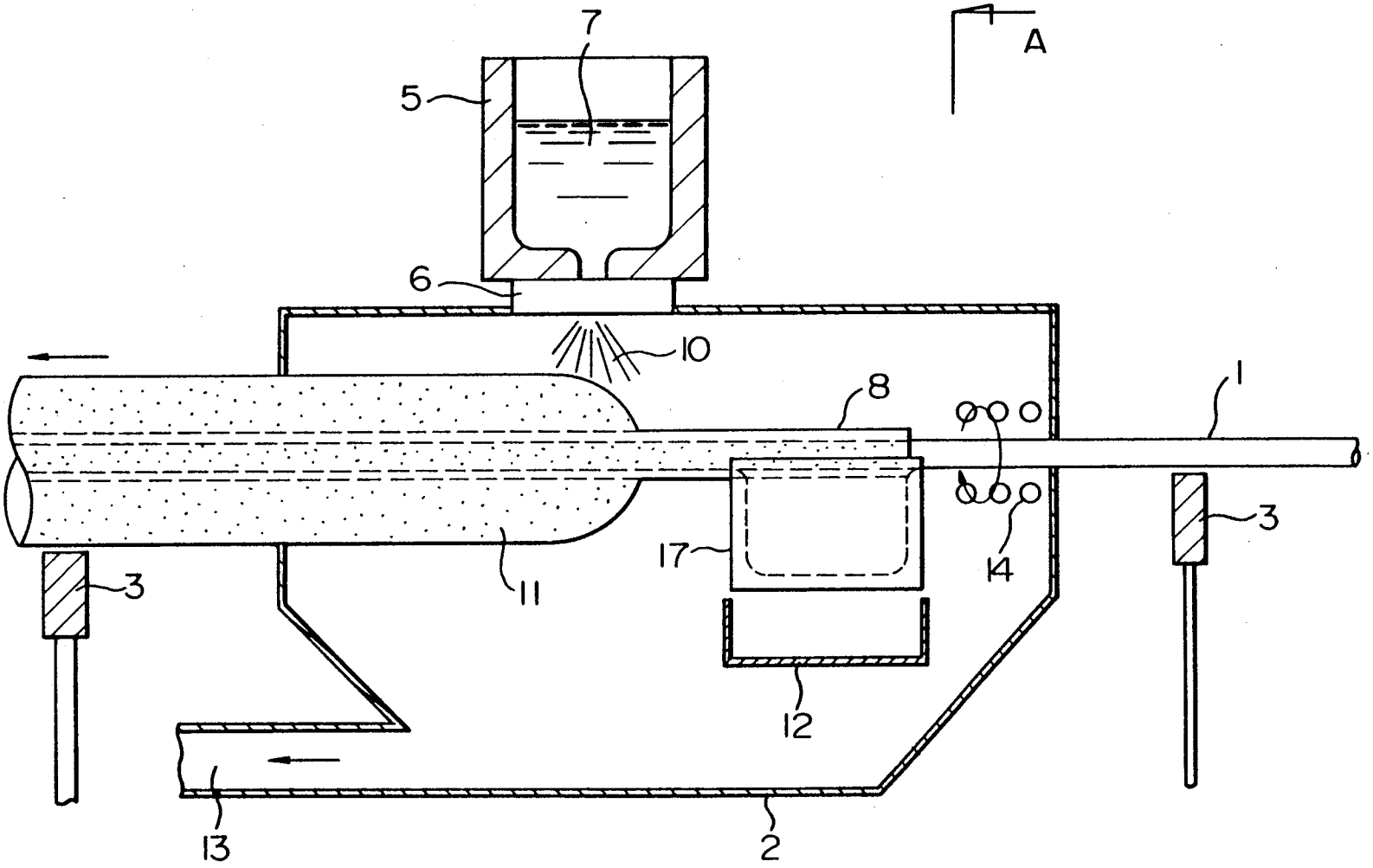
FIG. 3 schematically illustrates a third embodiment of the present invention.
Figure 4:
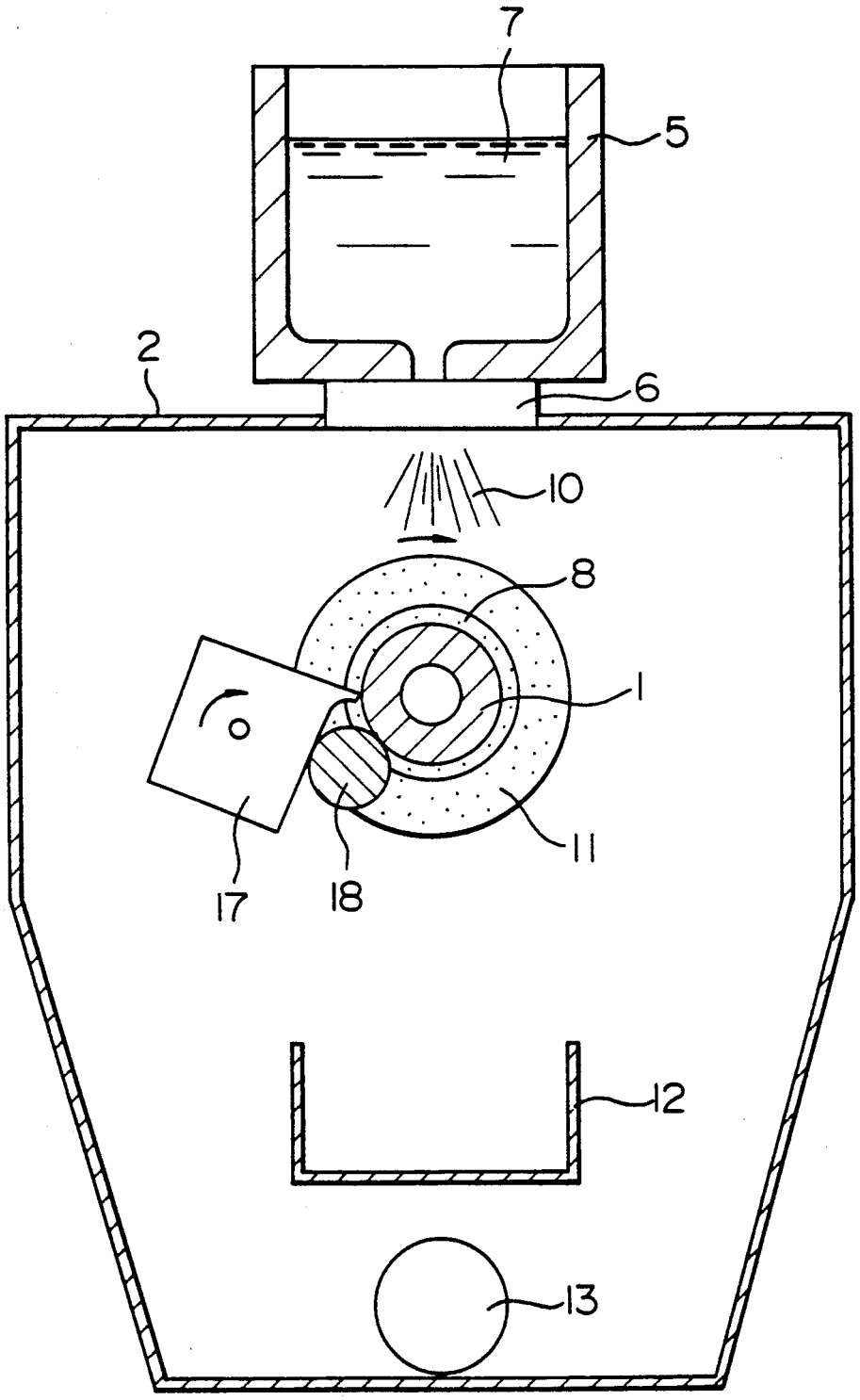
FIG. 4 is a side view as seen along the arrow A as shown in FIG. 3.

FIG. 3 schematically illustrates the third embodiment and FIG. 4 is a side view as seen along the arrow A as shown in FIG. 3. In a similar manner to the first and second embodiments, the third embodiment is suitable in forming a long size clad preform of iron or non-ferrous metal having a hollow therein or having a solid core.

Referring to FIGS. 3 and 4, denoted by numeral 1 is a collector or base material for long size tube, which transversely penetrates a chamber 2 and is supported by collector support bases 3, 3 provided outside the chamber 2. It is rotated at 5–500 rpm and is adapted to move slowly from right to left as shown in the figure. While this collector or base material 1 will become a collector when producing a tube preform and it will become the base material when producing a permanently clad preform, both will be referred to as a collector in the followings.

Inside the chamber 2, a preheating container 17 is provided in a manner capable of being tilted at the upstream side in the traveling direction of the collector 1. Further, on the ceiling side of the chamber 2, a container 5 constituted such as by a tundish or crucible for spray deposit is provided at the downstream side of the preheating container 17. An atomizer 6 is attached to the lower side of the container 5. While these preheating container 17 and the container 5 contain molten metals 7 of the same material, the molten metal 7 in the preheating container 17 is maintained at a temperature slightly higher than that of the molten metal in the container 5. The pouring outlet of the preheating container 17 is constructed to be wide so that a metal layer 8 of a uniform thickness may be formed when a melt is thinly poured onto the periphery of the collector 1. The temperature of the metal layer 8 is measured by a thermometer such as a pyrometer (not shown) so as to adjust the tilting of the preheating container 17 and to control the amount of melt to be poured.

It should be noted that a supplementary correcting roll 18 is provided adjacent to the collector 1 under the position where the preheating container 17 is arranged so as to further the flattening of the metal layer 8 and to prevent dropping of the metal flow. Furthermore, a preheater 14 may be additionally provided as required at the upstream side (with respect to the traveling direction of the collector 1) of the preheating container 17.

Moreover, a dish 12 lined with refractory is provided below the preheating container 17 so as to collect a part of the poured metal which has not been captured by the collector 1. Further, a part of the spray flow 10 from the container 5 not captured by the collector 1 is collected by a dust collector (not shown) by way of an exhaust ventilator 13 in a similar manner as an ordinary spray deposit apparatus.

The operation of the third embodiment will now be described.

Firstly, a preheating molten metal flow is thinly poured from the wide pouring outlet of the preheating container 17 onto the outer periphery of the rotating collector so as to form a flat metal layer 8 over the entire circumference thereof. At this time, extreme roughness on the layer surface is eliminated as required by the supplementary correcting roller 18 to prevent the occurrence of porous layer due to extreme roughness on the surface. As a result, the collector 1 is uniformly preheated also in the axial direction thereof. This preheated portion of the collector 1 is moved to the position directly below the container 5 for spray deposit to cumulate the spray flow 10. It should be noted that, while such spray flow 10 is scattered within the chamber 2 and a part of which will be mixed into the tundish 17, a problem does not occur because the molten metal is of the same material. Consequently, the collector 1 may be preheated by the previously coated metal layer 8 to prevent the occurrence of porosity. Further, even when spray deposit is effected under an unfavorable condition where the occurrence of a porous layer is possible, a porous layer is dissolved and eliminated by the metal layer 8.

Figure 5A:
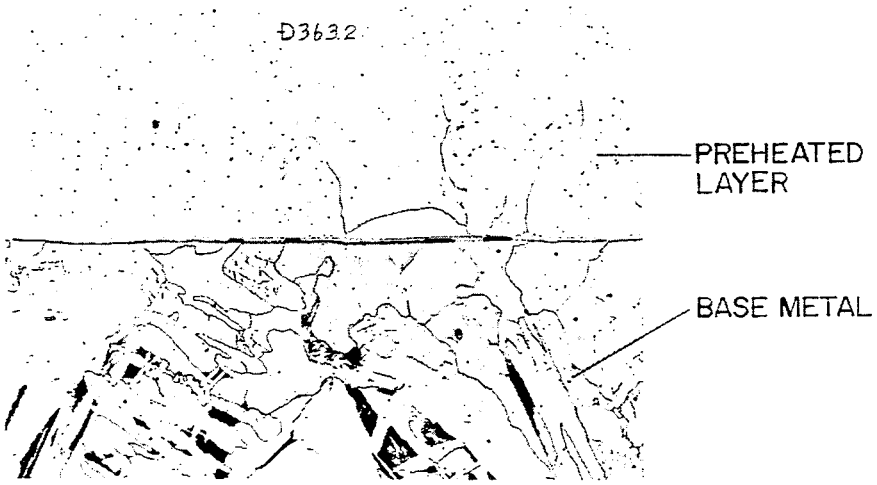
FIGS. 5*a* and 5*b* are microphotographs of section of cylindrical preform produced, respectively, by the apparatus as shown in FIGS. 3 and 4 and by a conventional method.
Figure 5B:
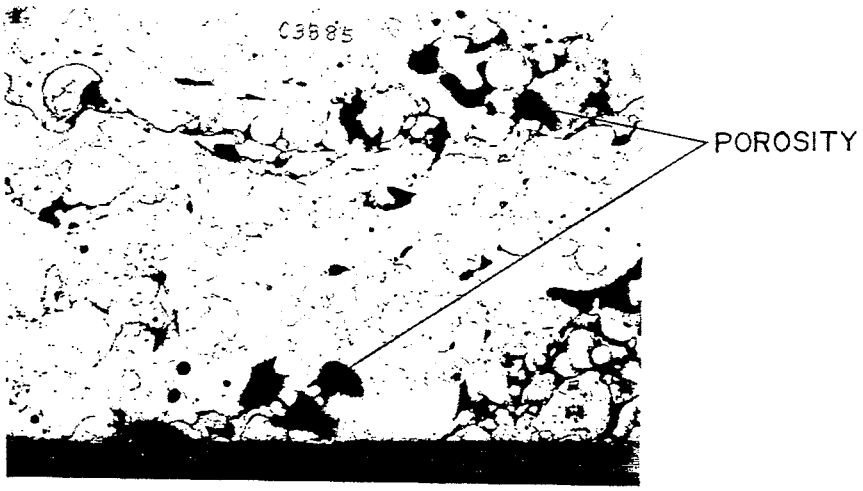
FIG. 5b PRIOR ART

FIGS. 5*a* and 5*b* are photographs of structure respectively of a long size preform formed in accordance with the third embodiment and of a long size preform formed by an ordinary spray deposit method.

The microphotograph shown in FIG. 5*a* is a microphotograph (×100) of a section of a long size preform formed in accordance with the third embodiment (formed of SUS304 as defined by JIS using JIS:SS41 as base metal), and the microphotograph shown in FIG. 5*b* is a microphotograph (×100) of a section of one (JIS:-SUS304) formed in accordance with an ordinary spray deposit method on an ordinary collector (JIS:SS41 for example as base material). As can be seen from these photographs, with an ordinary spray deposit method, a large number of pores appear in the interface of the joining portion between the lower surface of the preform and the collector, and the preform and the collector are not bonded. With the present embodiment, however, bonding of the preheated layer and the base metal is sufficient and the bonding between the preheated layer and the spray layer is also sufficient.

As can bee seen from these results with the present embodiment, the surface joining between the base metal and the preheated layer is sufficiently performed, and its advantage is conspicuous especially when a permanently clad material is to be produced.

A fourth embodiment of the present invention will now be described with reference to FIG. 6 and FIGS. 7*a* and 7*b*.

Unlike the first through third embodiments as described above, this embodiment is suitable in forming a sheet preform.

Figure 6:
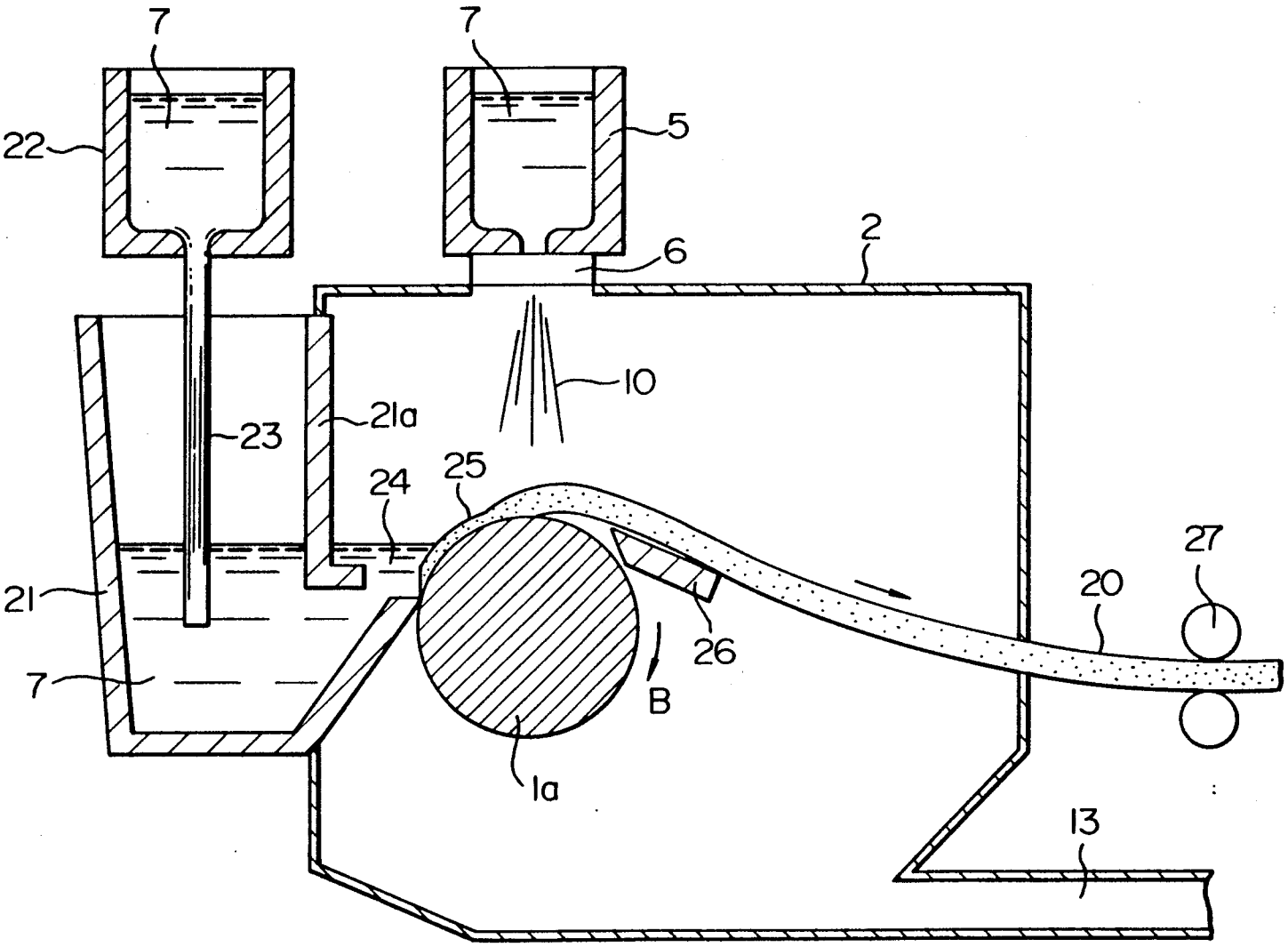
FIG. 6 schematically illustrates a fourth embodiment of the present invention.
Figure 7A:
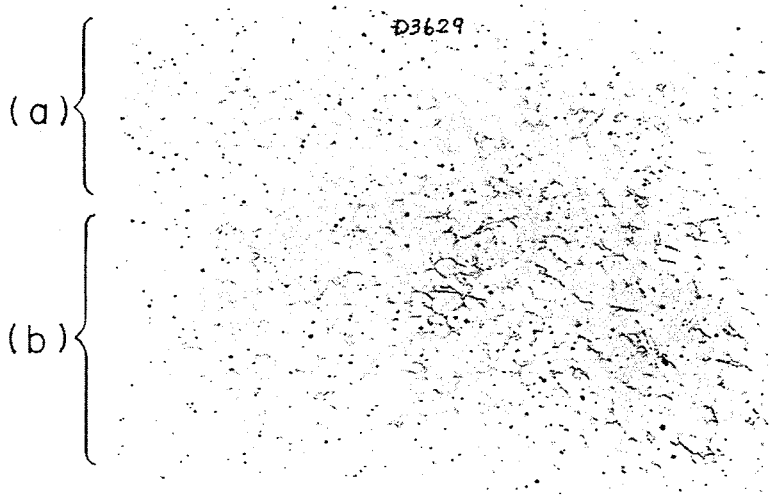
FIGS. 7*a* and 7*b* are microphotographs of section of sheet preform produced, respectively, by the apparatus as shown in FIG. 6 and by a conventional method.

FIG. 6 schematically illustrates an apparatus of the fourth embodiment, and FIG. 7*a* is a microphotograph of a preform formed in accordance with the fourth embodiment.

Referring to FIG. 6, a casting container 21 is provided adjacent t the upstream side of the pass line of the sheet preform 20 within a chamber 2 of an inert atmosphere where spray deposit is to be performed.

A ladle 22 is positioned above the casting container 21 so that a molten metal (JIS:SUS304 for example) 7 in the ladle 22 may be supplied to the casting container 21 by way of a nozzle 23. Further, one of the side walls of the casting container 21 constitutes a hidden weir 21*a*, and a supplying section 24 having its width substantially corresponding to the length of a single roll type collector 1*a* to be described later is horizontally extended along the direction of the length of the collector 1*a* at the lower side of the weir 21*a*.

The single roll type collector 1*a* is rotatably provided in a transverse direction in the above described chamber 2 so that it contacts the distal end of the supply section 24. Thus, when the single roll type collector 1*a* is rotated, the molten metal in the supply section 24 adheres to the surface of the collector 1*a* and is pulled up to form a metal layer 25 which will be sheet base material. Though not shown in the figure, the single roll type collector la has a diameter for example of about 4 m, is constructed by winding thin sheet steel around the periphery thereof and is adapted to be cooled from the inside in the same manner as a roll used in an ordinary single roll type strip caster. Further, an atomizer 6 is positioned above the single roll type collector 1*a* so that the molten metal 7 in the container 5 is caused to cumulate as a spray flow 10 on the metal layer 25 formed on the surface of the single roll type collector 1*a*.

That is, the single roll type collector 1*a* serves the two functions of a mold and spray deposit facility. Further, a separating shoe 26 is provided at the opposite side from the casting container 21 of the single roll type collector la so that it facilitates the separation of the sheet preform 20 formed on the outer peripheral surface of the collector 1*a* and serves as the delivering guide of the sheet preform 20 during operation. Furthermore, pinch rolls 27 are provided at the outlet of the chamber 2 and an exhaust ventilator 13 is provided at the bottom portion thereof.

The operation of the fourth embodiment will now be described.

The molten metal 7 in the casting container 21 is directed to the supply section 24 through the underneath of the weir 21*a*. Impurities in the molten metal 7 is thus separated therefrom. Since the supply section 24 is formed such that it contacts the surface of the collector 1*a* to prevent the flowing out of the molten metal and that a part of the molten metal is caused to directly contact the outer peripheral surface of the collector 1*a*, the molten metal which contacts with the surface of the collector 1*a* is cooled to be solidified. Thus, when the collector 1*a* is rotated in the direction of the arrow B, the molten metal which contacts with the collector 1*a* is solidified on the surface of the collector 1*a* and is pulled up as it adheres thereto, and the metal layer 25 which will be the base material is thinly formed on the surface of the collector 1*a*.

Next, the metal layer 25 which will be the sheet base material is used as a collector. Sheet preform 20 is continuously formed such that a molten metal 7 of the same material or of different material as the sheet base material 25 is caused to cumulate as a spray flow 10 from the spray depositing container 5 to the thickness several times that of the base material 25. Thus obtained sheet preform 20 is stripped from the surface of the single roll type collector 1*a* by the separating shoe 26 and is pulled out of the chamber 2 by the pinch rolls 27.

Figure 7B:
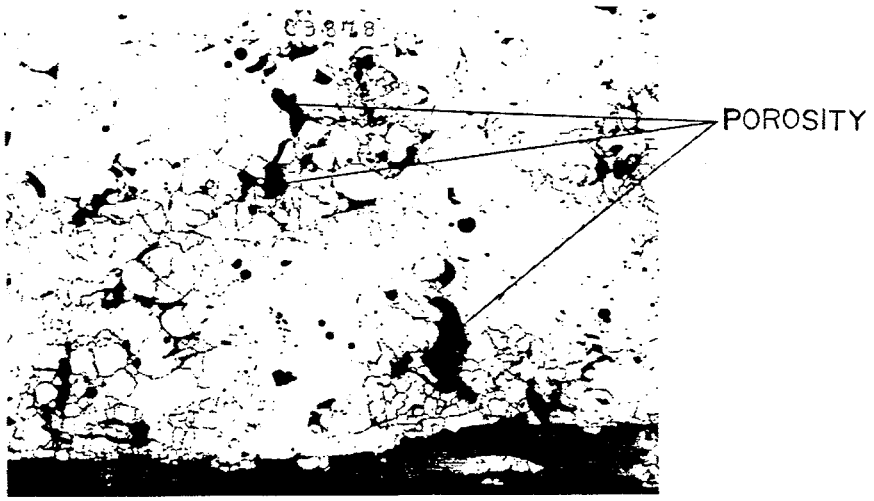
FIG. 7b PRIOR ART

FIGS. 7*a* and 7*b* are photographs of the structures respectively of the sheet preform 20 formed according to the fourth embodiment and of a sheet preform formed by an ordinary spray deposit method. That is, the microphotograph shown in FIG. 7*a* is a microphotograph of a section (×100) of sheet preform (SUS304) 20 formed according to the fourth embodiment, and FIG. 7*b* shows a microphotograph of a section (×100) of sheet preform (JIS:SUS304) formed on an ordinary plate collector by spray deposit method. As can be seen from these photographs, the boundary surfaces of the collector and the deposit layer in FIG. 7*b* based on an ordinary spray deposit method ar not joined with each other and the occurrence of porosity is seen in the deposited layer. In the photograph of FIG. 7*a* of the present embodiment, however, the boundary surfaces of the layer (b) of the sheet base material formed on the single roll type collector 1*a* and the deposit layer (a) are completely bonded each other and an occurrence of porosity is not seen in the deposit layer (a).

As can be seen from this result, in FIG. 7*a* of the present embodiment, since the superficial part of the sheet base material 25 formed on the single roll type collector 1*a* is suitably cooled by the spray flow 10, cooling as a whole is encouraged and defects due to temperature difference do not occur. In addition, it is presumed that porosity does not appear in the deposit layer (b), because the spray flow 10 is cumulated on the collector (sheet base material 25) which is being heated.

It should be noted that, while in the present embodiment the vertical position of the atomizer 6 is fixed, the present invention is not limited to this and the vertical position of the atomizer 6 may be varied to change the flying distance of the spray flow 10 so as to control the temperature of particles to be deposited on the sheet base material 25.

In accordance with present invention, since a collector or base material for forming a hollow or solid preform is transversely provided in a manner penetrating a chamber, a long size preform may be easily formed. In addition, since a metal layer is previously formed around the periphery of the collector or base material to preheat or to bond the collector or base material so that no roughness occurs on the metal layer surface and uniform heating may be performed despite the fact that it is of a long size, it is possible to prevent an occurrence of porosity and to produce a long size clad preform of high quality.

Further, in accordance with an embodiment of the present invention, since a sheet base material is continuously formed by a single roll type collector and spray deposit is effected on the sheet base material within a chamber of inert gas, productivity of a single roll type strip caster is greatly improved. In addition, the superficial part of the sheet base material is cooled by a spray flow and the occurrence of porosity at the time of depositing is prevented by the sheet base material which is at a relatively high temperature. A sheet base material having high quality is produced.

What is claimed is:

1. A method of producing long size preform using spray deposit, comprising the steps of:

causing a cylindrical base material for a long size preform to move longitudinally within a chamber while rotating the base material about the axis thereof;

permanently forming a preheated metal layer on the outer periphery of the base material by permanently adhering a molten metal to said base material at the upstream side in the traveling direction of said base material within said chamber; and cumulating sprayed molten metal sprayed from a container over the metal layer on said base material by providing said container containing the molten metal for preforming spray deposit by means of an atomizer for ejecting an inert gas on the ceiling of said chamber at the downstream side in the traveling direction of said base material, said sprayed molten metal and said preheated metal layer being the same type of metal, and said sprayed molten metal being permanently fixed to said preheated metal layer;

whereby porosity on the base material side of the preform is inhibited.

2. A method of producing long size preform according to claim 1, wherein a second container containing the molten metal for preheating is provided on the ceiling of said chamber at the upstream side in the traveling direction of said base material to cause the preheating metal to flow down from the second container to form said metal layer around the outer periphery of said base material.

3. A method of producing long size preform according to claim 1, further comprising the step of:

preheating said cylindrical base material prior to an application of any metal thereto, wherein a preheater for performing said preheating is provided at the upstream side in the traveling direction of said collector and a second container containing the molten metal for forming said metal layer is provided on the ceiling of said chamber at the upstream side thereof to spray the molten metal at a low pressure onto the preheated base material from said second container to form said metal layer on said base material.

4. A method of producing long size preform according to claim 1, wherein a preheater for preheating and a second container containing a molten metal for preheating and having a pouring outlet extending longitudinally of the base material in proximity to the outer peripheral surface of said base material are provided at the upstream side in the traveling direction of said base material, and wherein the molten metal is poured from the pouring outlet of said second container to the preheated base material to form said metal layer on the outer periphery of said base material.

5. A method of producing sheet preform using spray deposit, comprising the steps of:

providing, adjacent to the upstream side of an inert atmosphere chamber having a single roll type collector therein, a casting container containing a molten metal and having an outlet in proximity to a side surface of said collector and forming a metal layer for a certain angular range over the outer periphery of the collector by rotating the collector while continuously pouring the molten metal over the outer periphery of the collector from the pouring outlet of said casting container;

providing on the ceiling of said chamber a container containing a molten metal for performing spray deposit by way of an atomizer ejecting an inert gas and forming a preform by cumulating the molten metal sprayed from said container on the metal layer on the outer periphery of said collector;

providing, in said casting container, a hidden weir at one end thereof, said hidden weir projecting downward below the surface of the molten metal, for preventing impurities in said molten metal from being poured with said molten metal onto said preform; and pulling out the preform formed on said collector toward the downstream side of said chamber while continuously stripping it off from the collector toward the side thereof opposite to said pouring outlet of said casting container.

6. A method of producing sheet preform as recited in claim 5, further comprising the step of:

providing a separating shoe adjacent said collector, said separating shoe for continuously stripping the preform off the collector.

7. A method of producing sheet preform as recited in claim 5, wherein said container containing the molten metal is disposed at a position directly above said collector.

* * * * *